US009276351B2

(12) United States Patent
Kunert et al.

(10) Patent No.: US 9,276,351 B2
(45) Date of Patent: Mar. 1, 2016

(54) COMPOSITE INSERT

(71) Applicant: ROBERT BOSCH GMBH, Stuttgart (DE)

(72) Inventors: Peter Kunert, Altweg (DE); Gabor Klimaj, Budapest (HU)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 14/373,608

(22) PCT Filed: Nov. 30, 2012

(86) PCT No.: PCT/EP2012/074024
§ 371 (c)(1),
(2) Date: Jul. 21, 2014

(87) PCT Pub. No.: WO2013/110376
PCT Pub. Date: Aug. 1, 2013

(65) Prior Publication Data

US 2015/0079828 A1 Mar. 19, 2015

(30) Foreign Application Priority Data

Jan. 23, 2012 (DE) ..... 10 2012 200 918

(51) Int. Cl.

| | |
|---|---|
| ***H01R 43/24*** | (2006.01) |
| ***H01R 13/52*** | (2006.01) |
| ***H01R 13/405*** | (2006.01) |
| ***H01R 13/504*** | (2006.01) |

(52) U.S. Cl.
CPC ..... *H01R 13/521* (2013.01); *H01R 13/405* (2013.01); *H01R 13/504* (2013.01); *H01R 43/24* (2013.01)

(58) Field of Classification Search
CPC .. B29C 45/14065; B29C 70/68; H01R 43/24; H01R 13/405; H01R 13/652
See application file for complete search history.

(56) References Cited

U.S. PATENT DOCUMENTS

| | | | | | |
|---|---|---|---|---|---|
| 3,611,257 | A | * | 10/1971 | Carkhuff | 439/587 |
| 3,614,715 | A | * | 10/1971 | Marx | 439/825 |
| 4,718,865 | A | * | 1/1988 | Cordeiro | 439/606 |
| 4,798,544 | A | * | 1/1989 | Hartman | 439/404 |
| 4,826,443 | A | * | 5/1989 | Lockard | 439/101 |
| 4,884,980 | A | * | 12/1989 | Bensing et al. | 439/606 |
| 5,350,322 | A | * | 9/1994 | Kondo | 439/862 |
| 5,567,175 | A | * | 10/1996 | Warden et al. | 439/490 |
| 5,647,751 | A | * | 7/1997 | Shulman et al. | 439/106 |

(Continued)

FOREIGN PATENT DOCUMENTS

| | | |
|---|---|---|
| DE | 196 53 831 | 6/1998 |
| DE | 10 2006 047938 | 4/2008 |

(Continued)

OTHER PUBLICATIONS

International Search Report for PCT/EP2012/074024, dated Feb. 6, 2013.

*Primary Examiner* — Gary Paumen
(74) *Attorney, Agent, or Firm* — Kenyon & Kenyon LLP

(57) ABSTRACT

A composite insert has at least one metallic contact element which is extrusion-coated with the aid of a premolded part which has a first three-dimensional sealing surface to an injection mold, a stiffener of the contact element being formed beyond a transition region of the premolded part to the injection mold.

6 Claims, 3 Drawing Sheets

(56) References Cited

U.S. PATENT DOCUMENTS

| | | | | |
|---|---|---|---|---|
| 6,076,258 | A | 6/2000 | Abe | |
| 6,290,512 | B1 * | 9/2001 | Mullen, Jr. | 439/106 |
| 6,767,226 | B2 * | 7/2004 | Varatta | 439/106 |
| 6,848,918 | B2 * | 2/2005 | Chuang | 439/106 |
| 6,981,896 | B2 * | 1/2006 | Su | 439/606 |
| 2003/0017752 | A1 | 1/2003 | Okamoto | |
| 2005/0014417 | A1 * | 1/2005 | Karino et al. | 439/606 |
| 2005/0054239 | A1 * | 3/2005 | Su | 439/606 |
| 2005/0197010 | A1 * | 9/2005 | Ching | 439/606 |
| 2014/0335741 | A1 * | 11/2014 | Uno | 439/736 |

FOREIGN PATENT DOCUMENTS

| | | |
|---|---|---|
| DE | 10 2006 062 311 | 7/2008 |
| JP | 2009 066858 | 4/2009 |
| JP | 2009066868 A | 4/2009 |

* cited by examiner

COMPOSITE INSERT

BACKGROUND OF THE INVENTION

1. Field of the Invention

The present invention relates to a composite insert. The present invention also relates to a method for manufacturing a thermoplastic device having a plug cavity.

2. Description of the Related Art

The "2K direct extrusion coating" technique is known in more recent sensor generations in the automobile sector. An electronic system of the sensor makes contact with inserts in a separate manufacturing station, these inserts simultaneously forming plug-in contacts. A composite made up of a sensor and an insert (composite insert) is enclosed using an elastomer shell and then extrusion-coated using thermoplastic material with the aid of a forming tool. In order to ensure trouble-free operation of the sensor, a sensor element must be situated in a precisely defined position within the overall sensor.

Extrusion-coating with thermoplastic material may exert high forces on the composite insert, possibly causing deflections of the plug-in contacts and thus deviations from the target position. Although a specific design of the composite insert may in principle reduce the deflection of the composite insert, the plug area generally constitutes a weak point of a sensor manufactured in such a way.

A housing having a metallic insert is known from published German patent application document DE 10 2006 062 311 A1, the metallic insert being at least partially enclosed by the housing. An electrically non-conducting enclosure directly and at least partially encloses the metallic insert.

BRIEF SUMMARY OF THE INVENTION

The object of the present invention is to provide an improved manufacturing method for manufacturing a thermoplastic device having a plug cavity.

The object is achieved using a composite insert having at least one metallic contact element which is extrusion-coated with the aid of a premolded part. The composite insert is characterized in that the premolded part has a first three-dimensional sealing surface to an injection mold, a stiffener of the contact element being formed beyond a transition region of the premolded part to the injection mold.

A greater flexural strength of the composite insert is advantageously achieved during the manufacturing process with the aid of the increased rigidity of the at least one metallic contact element according to the present invention. Improved sealing of the composite insert during an extrusion-coating of the composite insert which is inserted into the injection mold is thus achieved with the aid of the first three-dimensional sealing surface of the composite insert to an injection mold. A thermoplastic device having a plug cavity may be manufactured without or with greatly reduced injection-molding defects as an advantageous result of this specific embodiment of the composite insert.

One preferred specific embodiment of the composite insert according to the present invention is characterized in that the first three-dimensional sealing surface is formed tapering away from the transition region to the injection mold. In this way, inaccuracies or manufacturing tolerances of the composite insert or the injection mold may compensate for each other, thereby essentially eliminating disadvantageous effects of the aforementioned manufacturing tolerances of the utilized elements.

One preferred specific embodiment of the composite insert according to the present invention is characterized in that angles of tapers of the first three-dimensional sealing surface are formed in a range from approximately 5 degrees to approximately 10 degrees. A particularly good contact stability is advantageously achieved between the composite insert and the injection mold via such an embodiment of angles of the tapers of the first three-dimensional sealing surface.

One additional specific embodiment of the composite insert is characterized in that contact surfaces of the first three-dimensional sealing surface are fitted to corresponding contact surfaces of a second three-dimensional sealing surface of the injection mold. In this way, a particularly well formed connection with contact stability is achieved between the composite insert and the injection mold, thereby achieving a particularly low-defect manufacture of the thermoplastic device having the plug cavity.

According to another aspect of the present invention, a method for manufacturing a thermoplastic device having a plug cavity is provided, having the steps of:

- inserting a composite insert into an injection mold, a transition region between the composite insert and the injection mold being essentially completely sealed with the aid of three-dimensional sealing surfaces of the composite insert and the injection mold, a stiffener of at least one metallic contact element being formed within a premolded part beyond the transition region;
- extrusion-coating the composite insert and the injection mold using thermoplastic material with the aid of a forming tool; and
- removing the injection mold.

With the aid of the method according to the present invention, it is advantageously possible to produce essentially defect-free thermoplastic assemblies having a plug cavity. This is achieved via two design measures which relate to a stiffener of a transition region between the composite insert and the injection mold. Three-dimensional sealing surfaces are provided on the composite insert and on the injection mold, which support a particularly contact-stable connection between the composite insert and the injection mold during the extrusion-coating process using thermoplastic material. In this way, essentially no thermoplastic material may enter between the composite insert and the injection mold, thereby facilitating an essentially defect-free manufacture of the plug cavity of the thermoplastic assembly.

The present invention is described in greater detail below having additional features and advantages based on multiple figures.

DETAILED DESCRIPTION OF THE INVENTION

Figure 1:
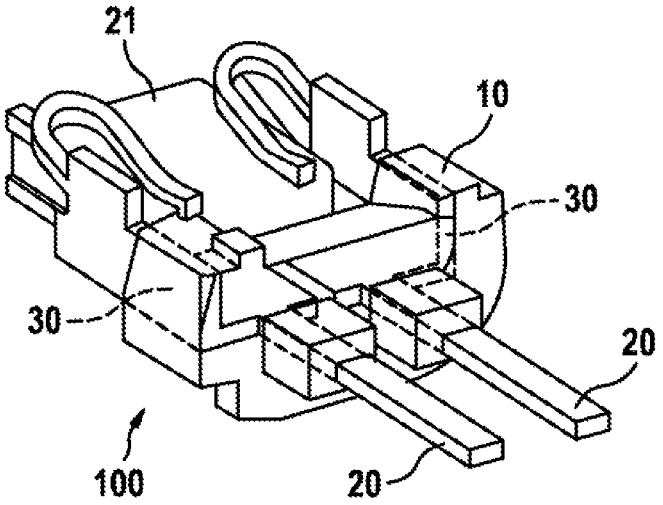
FIG. 1 shows a composite insert according to the related art.

FIG. 1 shows a composite insert 100 according to the related art in a perspective view. Composite insert 100 includes an electronic device 21 (for example, an electronic sensor), which is secured on both sides and electrically contacted in composite insert 100 by metallic tabs or brackets. The metallic tabs are formed on one end of composite insert 100 facing a plug (not shown) as metallic contact elements 20 (for example, as pins or as contacts made of a Cu alloy). Metallic contact elements 20 are provided for making contact with electronic device 21 with the aid of the plug. One section of composite insert 100 is extrusion-coated with the aid of a so-called premolded part 10, which is preferably formed as an elastomer sheath. Premolded part 10 is situated in a transition region of composite insert 100 to an injection mold 40 (not shown in FIG. 1), the transition region constituting a sealing surface relative to injection mold 40 for a final extrusion coating of the entire composite insert 100 using a thermoplastic material. The transition region essentially constitutes a planar surface which is interrupted only by two small sheath structures of metallic contact elements 20 ("trousers"). A mechanical stability of composite insert 100 is primarily influenced by a shaping of the aforementioned metallic parts. A flexural rigidity of composite insert 100 may be increased via a targeted tab formation, in particular via a formation of stiffeners 30 of the metallic tabs.

Figure 2:
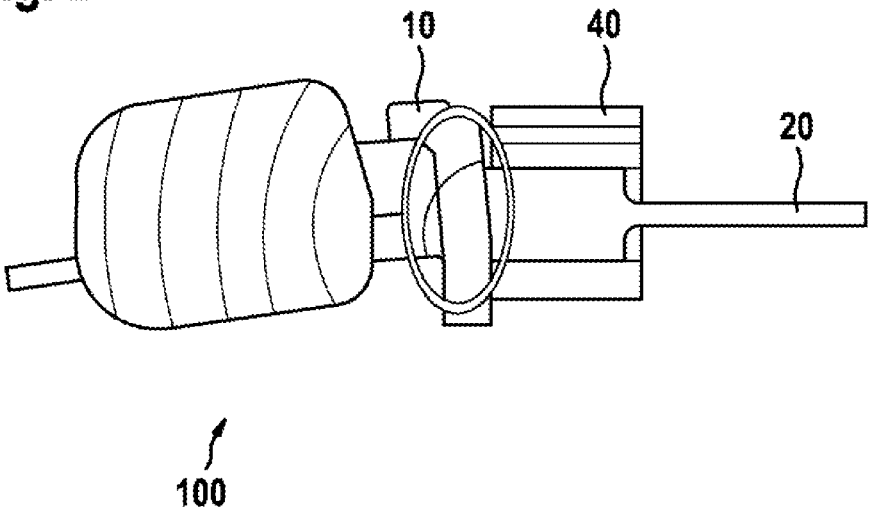
FIG. 2 shows a conventional composite insert which is inserted into an injection mold during an extrusion-coating process.

FIG. 2 shows a weak point of a connection of a conventional composite insert 100 to an injection mold 40. The figure shows, in a highly simplified manner, a conventional composite insert 100 which is inserted into an injection mold 40 during an extrusion-coating process. Based on the fact that a high molding pressure is intermittently exerted on composite insert 100 during the extrusion-coating, it is not possible to transmit the flexural rigidity of composite insert 100 to injection mold 40 via premolded part 10. This is indicated in FIG. 2 by an elliptical marking, which shows a slight tilting of premolded part 10 and a resulting gap between premolded part 10 and injection mold 40. Under a transverse load, composite insert 100 may deform, despite the rigid design of the metal parts in the transition region to injection mold 40. Thermoplastic material may thus disadvantageously enter the gap in an undesirable manner. In this way, injection-molding defects, for example, in the form of burrs due to overmolding, sink marks, etc., may occur, which may sharply reduce or even destroy a usability of the finished thermoplastic assembly if the plug is not able to make electric contact with metallic contact elements 20, or if its ability to do so is highly degraded.

Figure 3:
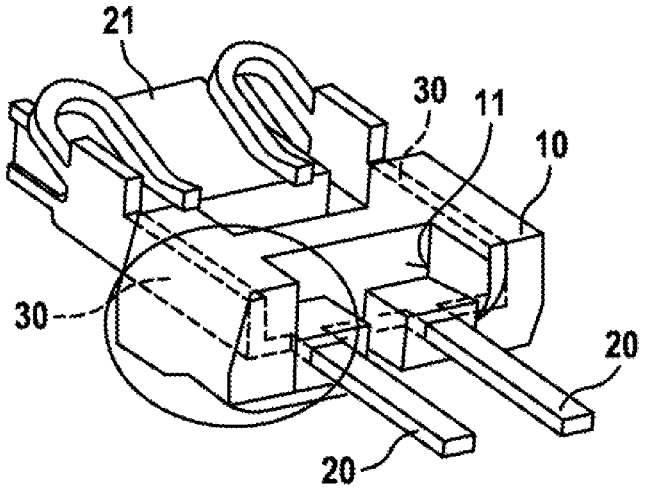
FIG. 3 shows one specific embodiment of a composite insert according to the present invention.

According to the present invention, it is now provided that composite insert 100 is designed in such a way that an improvement on the thermoplastic manufacturing process is possible via an improved connection between composite insert 100 and injection mold 40. FIG. 3 shows one specific embodiment of composite insert 100 according to the present invention, which provides an extension or continuation of the mechanical reinforcements or stiffeners 30 beyond the transition region to injection mold 40 (not shown in FIG. 3). One of the extensions of stiffeners 30 is indicated in FIG. 3 by an elliptical marking. In addition, premolded part 10 now has a first three-dimensional sealing surface 11. By continuing stiffeners 30 of the metal parts beyond the transition region, virtually into injection mold 40, a mechanical deformation of the system's composite insert 100/injection mold 40 may be sharply reduced or eliminated.

A uniformly stiff system is provided with the aid of the rigidity of composite insert 100 and first three-dimensional sealing surface 11, which has a counterpart in a second three-dimensional sealing surface 41 ("negative contour") of injection mold 40. A particularly contact-stable insert connection is achieved between composite insert 100 and injection mold 40 via an embodiment of contact surfaces of first three-dimensional sealing surface 11 as surfaces tapering away from injection mold 40 or as surfaces facing a central region of premolded part 10.

Figure 4A:
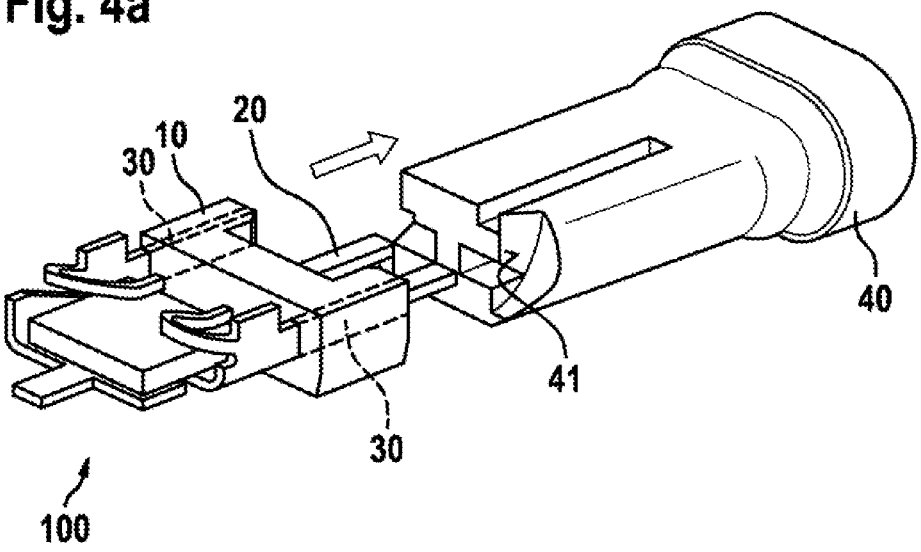
FIG. 4*a* shows one specific embodiment of a composite insert according to the present invention prior to an insertion into an injection mold.

FIG. 4*a* shows one specific embodiment of composite insert 100 according to the present invention prior to an insertion into an injection mold 40, which is formed as a metallic tool for forming a plug cavity in a thermoplastic assembly. It is apparent that injection mold 40 has a second three-dimensional sealing surface 41 as a mating surface to first three-dimensional sealing surface 11 of composite insert 100, second three-dimensional sealing surface 41 being correspondingly formed to first three-dimensional sealing surface 11. Sealing planes or contact surfaces of first three-dimensional sealing surface 11 and second three-dimensional sealing surface 41 are preferably formed as slanting touching surfaces, the angles relative to a longitudinal alignment of composite insert 100 and injection mold 40 preferably being formed in a range from approximately 5 degrees to approximately 10 degrees.

Figure 4B:
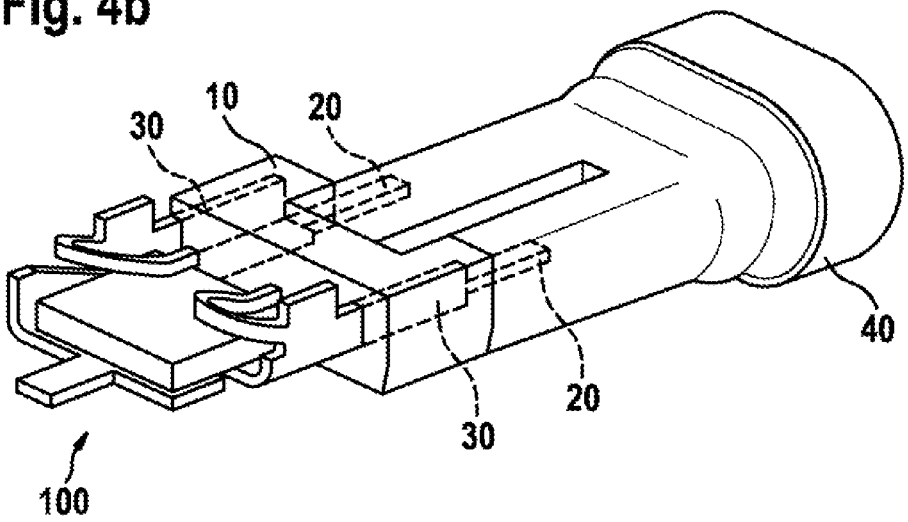
FIG. 4*b* shows one specific embodiment of the composite insert according to the present invention after the insertion into an injection mold.

FIG. 4*b* shows one specific embodiment of composite insert 100 according to the present invention inserted into an injection mold 40. It is apparent that lateral cantilevers of premolded part 10, which have stiffeners 30 of metallic contact elements 20 in their interiors, are applied to contact surfaces of second three-dimensional sealing surface 41. In this way, a uniformly stiff, effectively sealing unit is provided by composite insert 100 and injection mold 40. A thermoplastic material applied by injection molding under high pressure is therefore advantageously not able to adversely affect the contact stability between composite insert 100 and injection mold 40. As a result, it is possible to manufacture a thermoplastic assembly having a plug cavity which is formed within it which is defect-free to the greatest possible extent.

Figure 5:
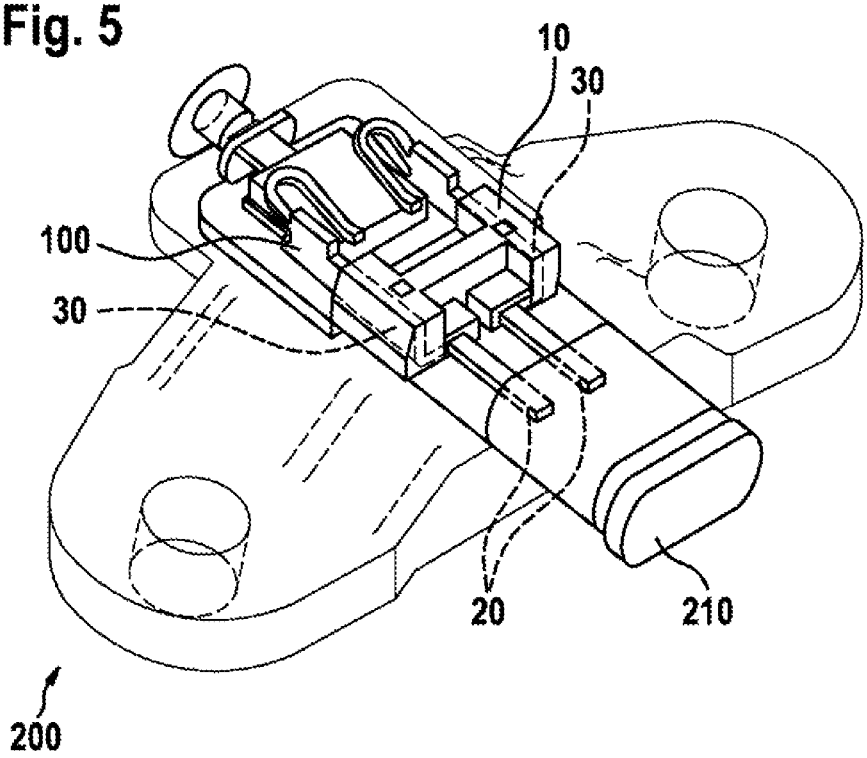
FIG. 5 shows a thermoplastic assembly having a plug cavity which has been manufactured according to the method according to the present invention.

FIG. 5 shows a thermoplastic assembly or device 200 in a perspective view, which has been manufactured with the aid of the method according to the present invention. Thermoplastic device 200 has a plug cavity 210 formed with the aid of injection mold 40 (not shown in FIG. 5). An injection mold 40 in the form of a metallic plug core is preferably used for manufacturing plug cavity 210 within thermoplastic device 200. The plug core serves to hold composite insert 100 during the extrusion-coating process and to form a plug cavity 210 within thermoplastic device 200. The outer shaping of thermoplastic device 200 is achieved with the aid of shaping injection molds, which, because they are not essential for the present invention, are not shown in FIG. 5.

Composite insert 100 according to the present invention having premolded part 10 which is specifically formed for manufacturing purposes is apparent in the interior of thermoplastic device 200. The specific embodiment of composite insert 100 is irrelevant for an operation of thermoplastic device 200 having electronic device 21 enclosed within it. A plug to be inserted into thermoplastic device 200 (not shown in FIG. 5) is plugged onto contact elements 20 up to the stop of premolded part 10, thus establishing a secure electrically conducting connection between electronic device 21 and the plug. Therefore, a particular advantage of the method according to the present invention is to provide a thermoplastic assembly 200 having a plug cavity 210 whose contact elements 20 are reliably capable of making electric contact with a plug.

In summary, the present invention provides an improved manufacturing method for manufacturing a thermoplastic assembly having a plug cavity. A particular advantage of the present invention is apparent in that it is possible to mass-produce a functional thermoplastic device with the aid of the method according to the present invention, a plug cavity of the thermoplastic assembly being free from injection-molding defects to the greatest possible extent. In this way, an improved connection design between the composite insert and the injection mold is advantageously provided for reducing deflections in the plug area. This is of particular importance for a proper functioning of the electronic device which is enclosed in the thermoplastic device.

As a result, it is possible to significantly increase a cost-effectiveness of the manufacturing process by minimizing or preventing rejects.

It will be obvious to those skilled in the art that features of the present invention may be suitably combined or modified without departing from the core of the present invention.

What is claimed is:

1. A composite insert, comprising:

a premolded part; and at least one metallic contact element which is extrusion-coated with the aid of the premolded part;

wherein the premolded part has a first three-dimensional sealing surface configured to sealingly contact an injection mold when the composite insert is inserted into the injection mold, and wherein a stiffener of the at least one metallic contact element is provided beyond a transition region between the premolded part and the injection mold when the composite insert is inserted into the injection mold, and wherein the first three-dimensional sealing surface is formed tapering away from the transition region between the premolded part and the injection mold.

2. The composite insert as recited in claim 1, wherein an angle of taper of the first three-dimensional sealing surface is in a range from approximately 5 degrees to approximately 10 degrees.

3. The composite insert as recited in claim 1, wherein the first three-dimensional sealing surface is fitted to a corresponding second three-dimensional sealing surface of the injection mold.

4. A method for manufacturing a thermoplastic device having a plug cavity, comprising:

inserting a composite insert having a premolded part into an injection mold, whereby a transition region between the composite insert and the injection mold is essentially completely sealed with the aid of three-dimensional sealing surfaces of the composite insert and the injection mold, wherein at least one stiffener of at least one metallic contact element is provided within the premolded part beyond the transition region between the composite insert and the injection mold;

extrusion-coating the composite insert and the injection mold using a thermoplastic material with the aid of a forming tool; and removing the injection mold.

5. The method as recited in claim 4, wherein the injection mold is a device for forming a plug cavity.

6. A thermoplastic device, comprising:

a plug cavity; and a composite insert including:

a premolded part; and at least one metallic contact element which is extrusion-coated with the aid of the premolded part;

wherein the premolded part has a first three-dimensional sealing surface configured to sealingly contact an injection mold when the composite insert is inserted into the injection mold, and wherein a stiffener of the at least one metallic contact element is provided beyond a transition region between the premolded part and the injection mold when the composite insert is inserted into the injection mold, and wherein the first three-dimensional sealing surface is formed tapering away from the transition region between the premolded part and the injection mold.

* * * * *